US006427673B2

(12) United States Patent
Morganti et al.

(10) Patent No.: US 6,427,673 B2
(45) Date of Patent: Aug. 6, 2002

(54) IGNITION COIL ASSEMBLY

(75) Inventors: Carl Rudolph Morganti, Farmington Hills, MI (US); Mark Joseph Bartasius, Laindon (GB); James Donald McCoy, Waterford, MI (US); Richard William Kautz, North Branch, MI (US); Tamra Kim Green, Stockbridge, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/775,146

(22) Filed: Feb. 1, 2001

Related U.S. Application Data

(60) Provisional application No. 60/180,577, filed on Feb. 4, 2000.

(51) Int. Cl.[7] ..... F02P 11/00

(52) U.S. Cl. ..... 123/633; 123/634

(58) Field of Search ..... 123/634, 633

(56) References Cited

U.S. PATENT DOCUMENTS

| | | | | | |
|---|---|---|---|---|---|
| 3,191,133 | A | | 6/1965 | Texsier | |
| 3,882,341 | A | | 5/1975 | Green | |
| 4,774,914 | A | * | 10/1988 | Ward | 123/633 |
| 5,170,767 | A | * | 12/1992 | Wada et al. | 123/633 |
| 5,241,941 | A | * | 9/1993 | Hancock et al. | 123/634 |
| 5,285,761 | A | * | 2/1994 | Hancock et al. | 123/634 |
| 5,603,306 | A | * | 2/1997 | Tai | 123/633 |
| 5,706,792 | A | * | 1/1998 | Boyer et al. | 123/634 |
| 6,259,344 | B1 | * | 7/2001 | Heritier-Best et al. | 123/634 |

* cited by examiner

*Primary Examiner*—Erick Solis
(74) *Attorney, Agent, or Firm*—John Kajander

(57) ABSTRACT

An ignition coil assembly having a coil spring (26) made of electrically conductive material, an electrical coil connected to deliver electrical energy from the ignition coil assembly 11 through the coil spring and a ferromagnetic member (30) disposed within the coil spring. A resistive spark plug (40) is electrically coupled to the coil spring (26). The spark plug and ferromagnetic member (30) form a high pass filter (51) and low pass filter (58) respectively to reduce radio frequency interference.

13 Claims, 6 Drawing Sheets

IGNITION COIL ASSEMBLY

RELATED APPLICATION

The present application claims priority to provisional U.S. patent application No. 60/180,577 filed on Feb. 4, 2000, which is hereby incorporated by reference.

BACKGROUND OF THE INVENTION

The present invention relates generally to ignition systems for internal combustion engines and more specifically to ignition coil assemblies used in such ignition systems.

DESCRIPTION OF THE RELATED ART

In ignition systems for internal combustion engines, one or more ignition coil assemblies are typically provided. Each assembly typically has a "primary" coil and a "secondary" coil, these coils being magnetically coupled. Relatively low-voltage electrical energy is switched though the primary coil, inducing higher voltage electrical energy in the secondary coil. This higher voltage is provided to an ignition device such as a spark plug. The higher-voltage energy breaks down an air gap in the spark plug, causing a spark which causes ignition in the engine.

The transient nature of the higher-voltage energy in the secondary circuit of an ignition coil tends to create electromagnetic fields which can be disruptive to electronic devices nearby. These fields are of considerably higher frequency than the frequency at which the inductively sourced energy from the ignition coil is delivered to the engine.

In one known method of trying to reduce the electromagnetic fields, a resistor is placed in the spark plug boot, in contact with the top of the spark plug (that is, in series in the secondary circuit of the ignition coil). Such a resistor cooperates with the inductance already in the secondary circuit (or, in the case of a wire-wound resistor, the resistor adds additional inductance) to filter the frequencies where electromagnetic fields are a concern. Although such a design may be generally effective in reducing electromagnetic fields, the design might not provide sufficient impedance at all frequencies where suppression is desired. Also, a resistor adds impedance not only in frequencies where suppression is desired, but also at lower frequencies, where spark energy is delivered. This reduces the amount of spark energy which is delivered. Further, the resistor suppression design adds additional electrical connections between the spark plug and the secondary ignition coil, adding potential unreliability to the system.

U.S. Pat. No. 3,131,133 uses a suppresser located in the spark plug boot. This is not a stand-alone element for RF filtering. The filtering scheme disclosed in the '133 patent uses capacitance in the high tension wire to form a filter. Two low pass filters are thus formed in the '133 patent. In such a design, a non-resistive spark plug is used. It is believed that if a resistive spark plug was used, the filter would be defeated. Also, since the '133 patent relies on capacitance from high tension wire, it is not compatible with coil-on-plug ignition, which does not use such wires.

U.S. Pat. No. 3,822,341 uses a ferrite-spring installed within the spark plug in the place of the normal resistive element. By placing the ferrite core within the location of the spark plug, a relatively small piece of ferrite is used and therefore high instantaneous current discharges that occur are believed to saturate the ferrite core too quickly. Also, such a design is also believed to have limited applications because the Curie temperature of the ferrite is believed to be reached for most applications. The Curie temperature is reached because spark plugs typically operate between 400 and 900 degrees to allow the ceramic surface to burn any carbon deposits thereon. Also, since the '341 patent uses the ferrite-spring that occupies the space normally used by a spark plug resistor, it is not possible to use a ferrite-spring combinationally with a spark plug resistor.

Thus, a design which reduces the potential unreliability of additional connections from a resistor element in the spark plug boot while effectively reducing electromagnetic fields and not reducing delivered spark energy will provide advantages over the prior art.

SUMMARY OF THE INVENTION

The present invention provides an ignition coil assembly. The ignition coil assembly comprises a coil spring made of electrically conductive material, an electrical coil connected to deliver electrical energy from the ignition coil assembly via the coil spring and a ferromagnetic member disposed within the coil spring.

Devices according to the present invention effectively suppress emitted electromagnetic fields and reduce the unreliability of an added resistor in the spark plug boot. Further, devices according to the present invention can be less expensive than an added resistor in the spark plug boot. The present invention thus provides considerable advantages over alternative designs. A resistive spark plug is coupled to the ignition coil in electrical contact with the coil spring. The resistive element within the spark plug in combination with the ferromagnetic member form a filter that suppresses radio frequency interference.

Other objects and features of the present invention will become apparent when viewed in light of the detailed description of the preferred embodiment when taken in conjunction with the attached drawings and appended claims.

DETAILED DESCRIPTION OF THE PREFERRED EMBODIMENT

Figure 1:
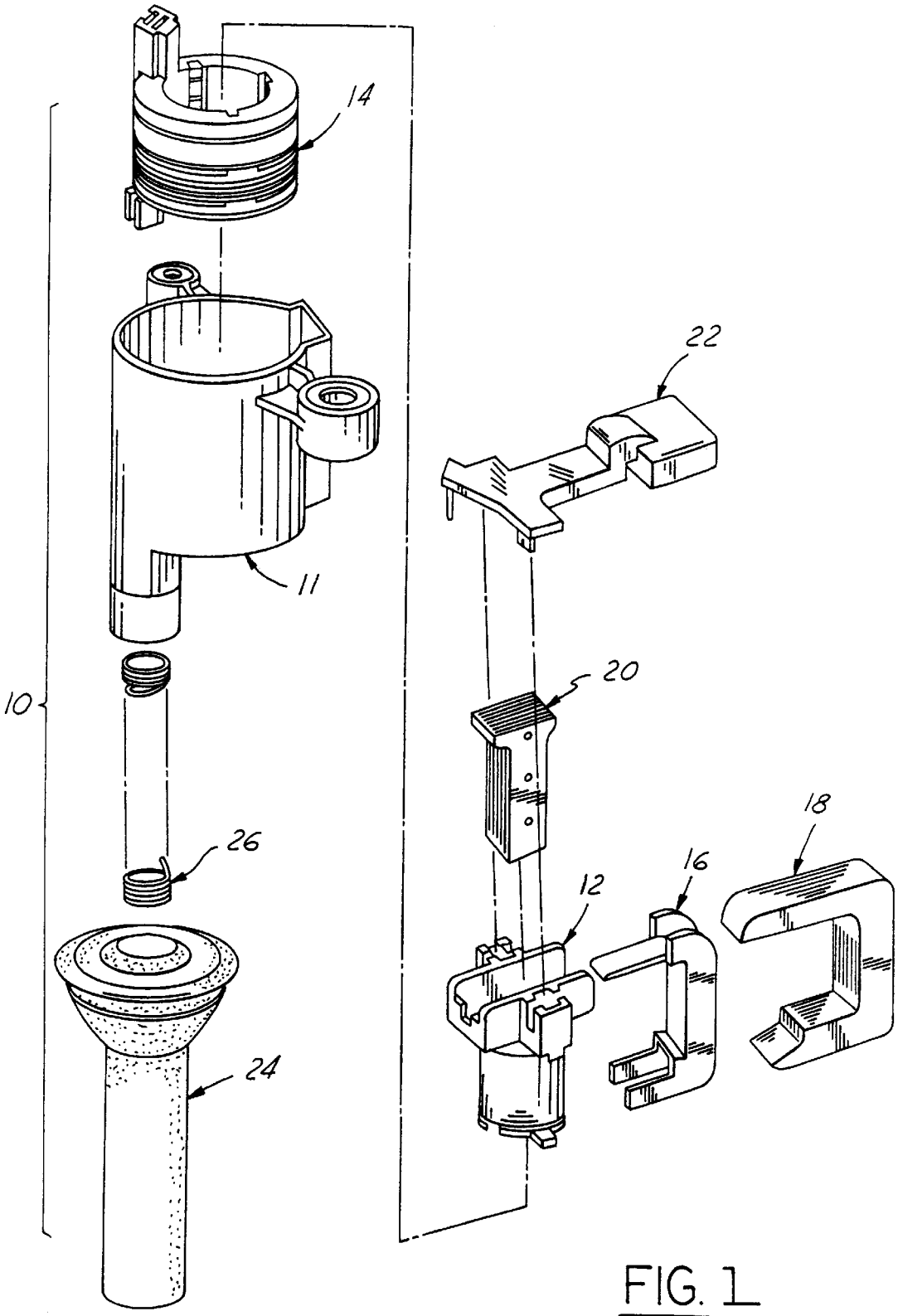
FIG. 1 is an exploded view of an ignition coil assembly 10 according to one embodiment of the present invention.

Refer first to FIG. 1, where one embodiment of the present invention is illustrated. FIG. 1 illustrates an ignition coil assembly 10 for an internal combustion engine. Ignition coil assembly 10 includes a molded plastic housing 11. Disposed within housing 10 is a primary coil assembly 12, which is disposed, within a secondary coil assembly 14. Ignition coil assembly 10 further includes clip 16 and laminated ferromagnetic core sections 18 and 20. An electrical connector assembly 22 is also provided to enable connection of primary coil assembly 12 to appropriate vehicle wiring. Through appropriate switching of electrical power provided to primary coil assembly 12, higher voltage spark energy is induced in secondary coil assembly 14.

Ignition coil assembly 10 also includes an elastomeric boot 24, within which is disposed a metallic coil spring 26. Boot 24 is designed to be pressed onto the body of a spark plug (not shown), with coil spring 26 then making the electrical connection between, the conductive spark plug tip and secondary coil assembly 14. Coil spring 26 is compressed by the tip of the spark plug when boot 24 is pressed onto the body of the spark plug.

Ignition coil assembly 10 of FIG. 1 is according to a "coil-per-plug" design, where one ignition coil assembly 10 is provided for each spark plug in the engine. If the reader requires more detail about the construction or use of such a "coil-per-plug" design, he is referred to U.S. Pat. No. 5,333,593, the complete disclosure of which is hereby incorporated by reference.

Figure 2:
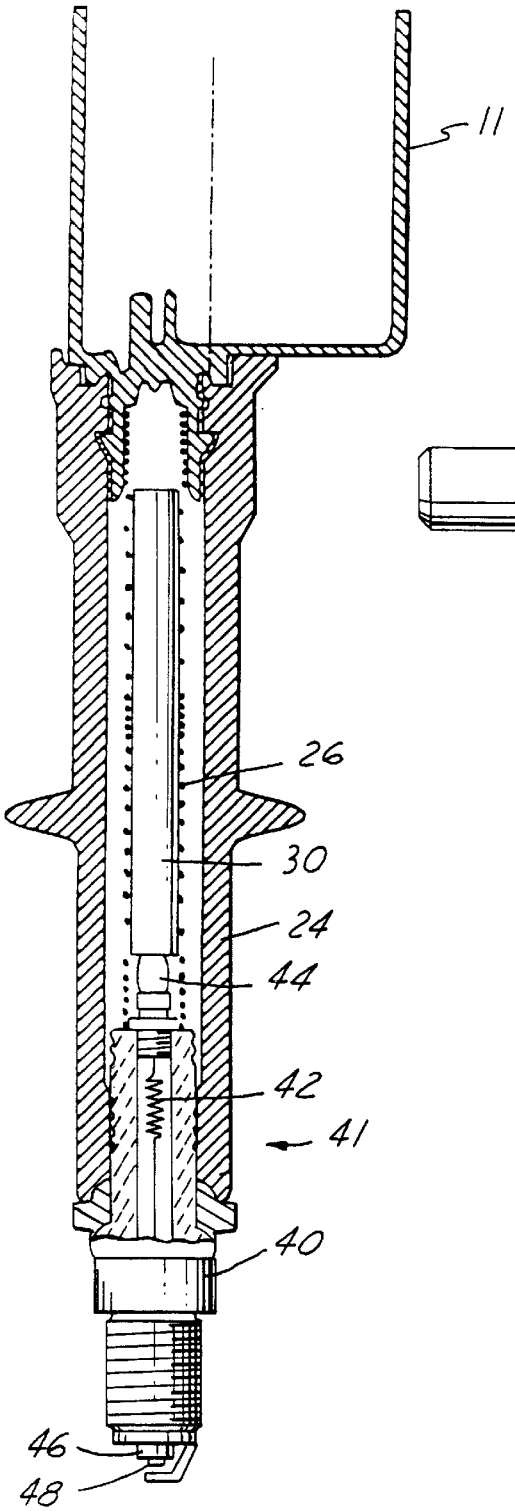
FIG. 2 is a partial cross-sectional side view of the ignition coil assembly 10 of FIG. 1.

Refer now additionally to FIG. 2. FIG. 2 is a partial cross-sectional side view of ignition coil 10 of FIG. 1. Located within spring 26 is a molded bead 30 of ferrite material (or other appropriate ferromagnetic material). Bead 30 increases the tendency of spring 26 to act as an inductor to the electrical energy delivered through secondary coil assembly 14 and spring 26 to the spark plug. The precise material and geometry of bead 30 can be selected such that the combination of spring 26 and bead 30 has the appropriate impedance versus frequency characteristic across to frequencies of interest. In particular, it is desirable to have low impedance at the relatively lower frequencies (e.g., below 10 kHz) where electrical spark energy is delivered from the inductance of the ignition coil to the spark plug, and higher impedance at the higher frequencies where electromagnetic fields of concern are generated.

Because bead 30 is not required to be in physical contact with either secondary coil assembly 14 or the spark plug to have the beneficial effect described here, bead 30 can be located away from the ends of spring 26.

Figure 3A:
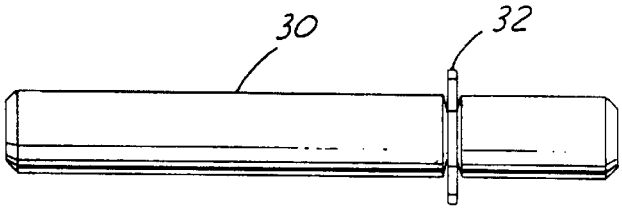
FIGS. 3A and 3B are side and end views, respectively, of ferrite bead 30 of FIG. 2 and a clip 32 designed to retain bead 30 within coil spring 26 of FIG. 2.
Figure 3B:
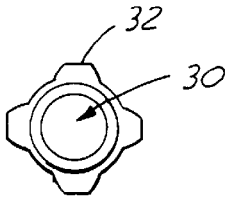

Refer now additionally to FIG. 3. If added retention for bead 30 is required in addition to retention provided by any contact of bead 30 with spring 26, a clip 32 can be provided. Clip 32 is preferably made of plastic and can be inserted in a groove in bead 30 after bead 30 is inserted into spring 26. Clip 32 would cooperate with spring 26 to retain bead 30 in place within spring 26. Clip 32 can also be replaced by a molded-in area of increased radius which would similarly cooperate with spring 26.

Referring back to FIG. 2, boot 24 is shown coupled to a spark plug 40 which, in combination, forms an ignition system 41. Spark plug 40 is illustrated in a partial cross-sectional view to reveal resistor 42 therein. Resistor 42 electrically couples a first tip 44 of spark plug 40 with a firing tip 46. Spark plug 40 although illustrated in a particular configuration, may be one of a variety of types of resistive spark plugs known to those skilled in the art. Tip 44 is electrically coupled to coil assembly 10 through coil spring 26.

Figure 4:
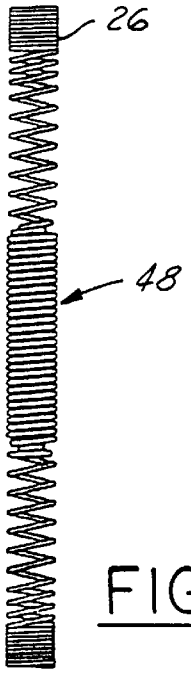
FIG. 4 is a side view of the ferrite bead and spring assembly of FIG. 2.

Referring now to FIG. 4, one embodiment of coil spring 26 is illustrated. Coil spring 26 has a central portion 48 which is used to house the bead 30 therein. Various durable metal materials may be used for coil spring 26. one example of a suitable material for coil spring 26 is 302 stainless steel per ASTM A313.

Figure 5:
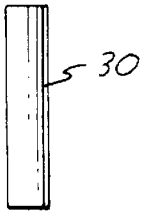
FIG. 5 is a side view of a ferrite bead according to the present invention.

Referring now to FIG. 5, a profile view of a bead 30 is illustrated. Preferably, bead 30 provides a predetermined inductance for use in the electrical circuit formed by the spark plug and ignition coil to form the ignition system.

Figure 6:
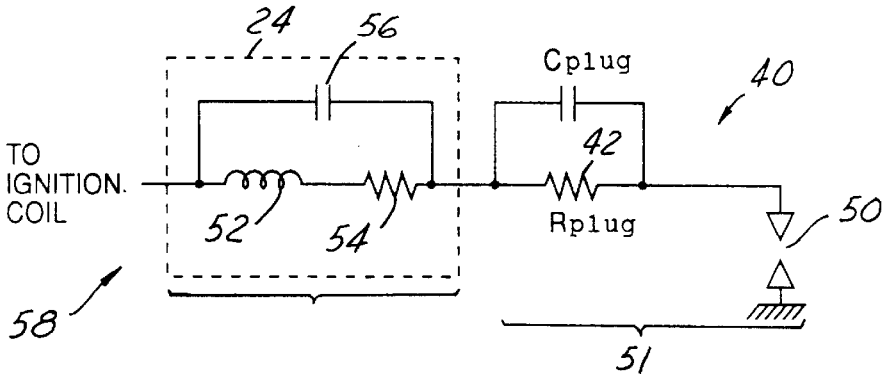
FIG. 6 is an equivalent circuit according to the present invention.

Referring now to FIG. 6, an equivalent electrical circuit of FIG. 2 is illustrated. Spark plug 40 has a plug capacitance $C_{plug}$ and a resistance $R_{plug}$ associated therewith. A gap 50 represents the firing end of the spark plug. The combination of the capacitor $C_{plug}$ and $R_{plug}$ form a high pass filter 51.

The components within boot 24 include coil spring 26 with bead 30. These two components together have an inductance represented by an inductor 52, a resistance represented by resistor 54, and a capacitance represented by capacitor 56. These three components form a low pass filter 58. Thus, when coupled together low pass filter 58 and high pass 51 are used to suppress radio frequency interference (RFI).

The capacitances of the spark plug and ignition coil assembly are inherent to these components and are parasitic parameters that detract from the ability of the ferrite-spring and spark plug resistor to filter. One advantage of the ferrite-spring is that it can be designed to hold the capacitance to a lower level than the capacitance in the spark plug. This is an important reason why the ferrite-spring can filter radio interference better than a typical spark plug resistor at frequencies above approximately 10 MHz.

Figure 7:
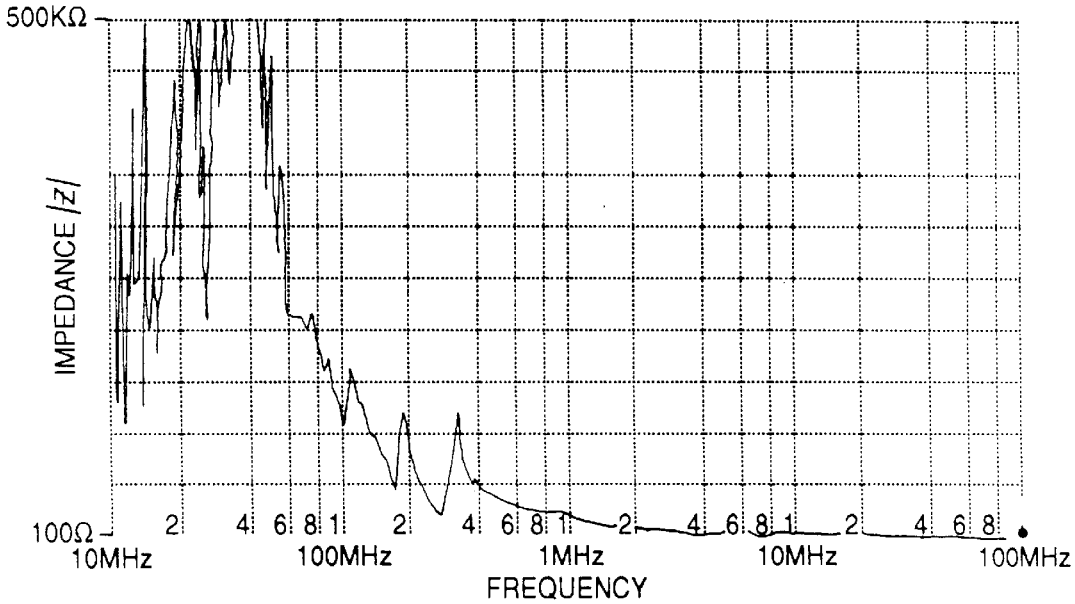
FIG. 7 is an impedance versus frequency plot for a typical production application.

Referring now to FIG. 7, an impedance versus frequency plot for an automotive vehicle is shown using a coil-on-plug ignition system. As can be seen, the impedance presented by the coil drops drastically with the frequency. The impedance is below 2 K at frequencies above 100 MHz. Most of the RFI suppression benefits are achieved with an impedance of 2 K.

Figure 8:
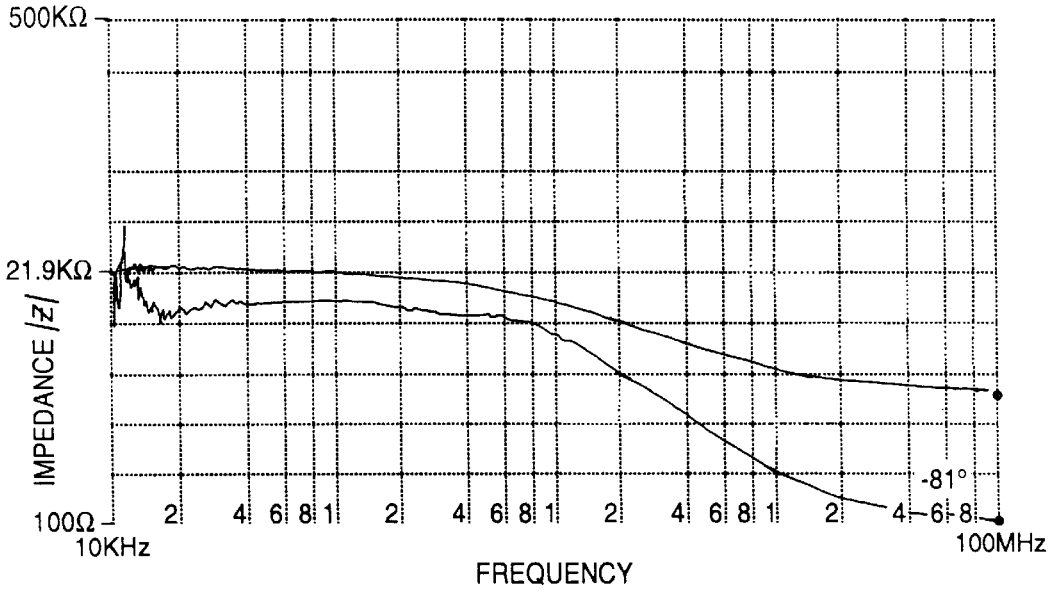
FIG. 8 is an impedance versus frequency plot illustrating phase angles and magnitudes for a common spark plug.

Referring now to FIG. 8, an impedance and phase angle plot of a typical Motorcraft spark plug is illustrated. As can be seen, above about 28.8 KHz, the phase angle becomes more capacitive.

Figure 9:
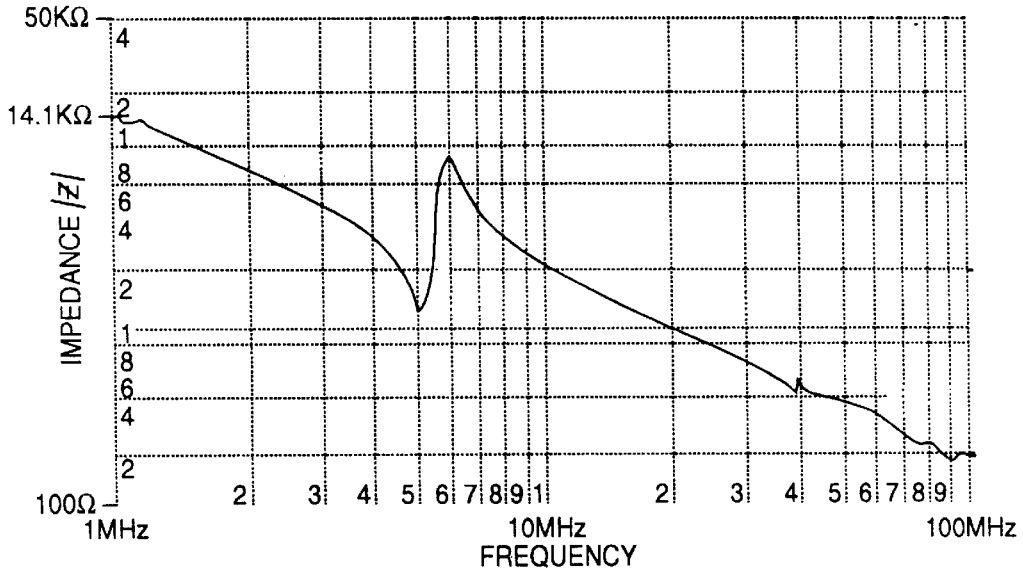
FIG. 9 is a plot of a conventional coil on plug used with a non-resistive spark plug.

Referring now to FIG. 9, an impedance plot for a coil-on-plug ignition with a non-resistive spark plug is illustrated. In this embodiment, a ferrite spring filter has not been used and shows the coil impedance dropping drastically above 10 MHz.

Figure 10:
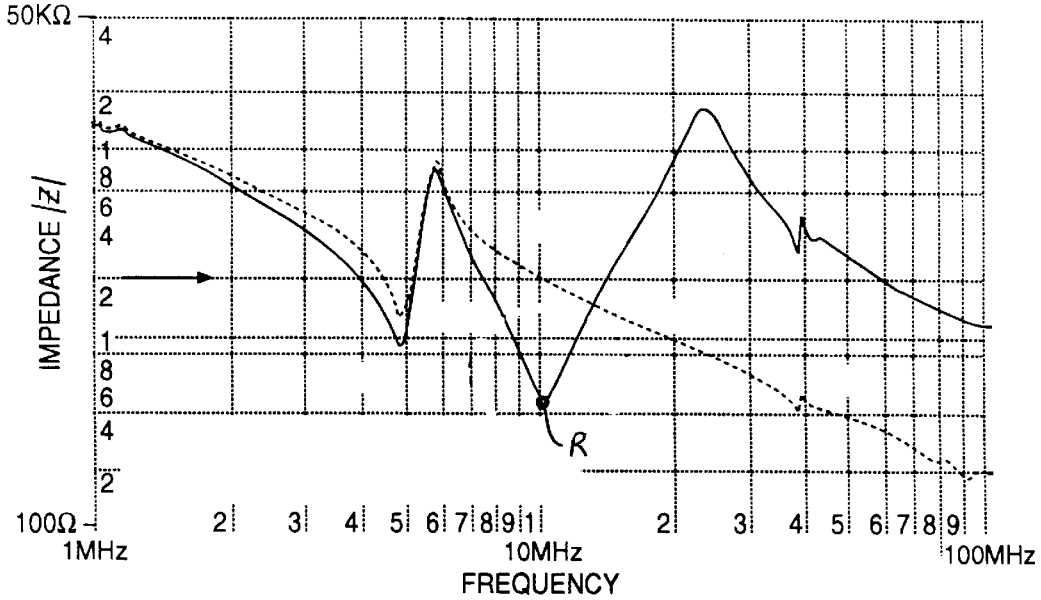
FIG. 10 is an impedance versus frequency plot of a coil on plug ignition system in series with a ferrite-spring and non-resistive spark plug.

Referring now to FIG. 10, a plot of impedance versus frequency is illustrated also with a non-resistive spark plug using a ferrite spring boot. As is shown, the impedance sweep when the coil and ferrite spring filter are connected in series is illustrated. Although this graph shows better filtering above 15 MHz than in FIG. 9, a resonant mode denoted by the symbol R is evident. At this resonant mode the impedance drops to about 460 at around 10 MHz. It is believed that because the impedance has dropped drastically below the 2 K benchmark, a substantial amount of radio frequency interference will pass therethrough.

Figure 11:
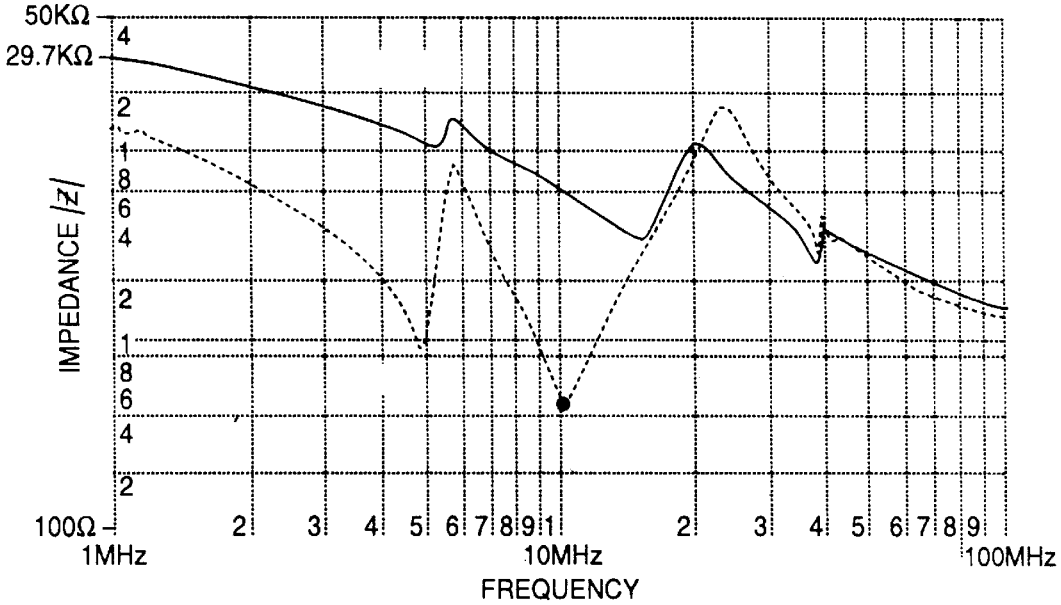
FIG. 11 is a plot of a system graphically illustrated in FIG. 10 using a resistive spark plug according to the present invention.

Referring now to FIG. 11, the same circuit as FIG. 10 was used but now includes a resistive spark plug such as that shown in FIG. 6. In this example, the advantageous combination of the resistive spark plug 40 with the ferrite spring filter prevents the impedance from dropping drastically at the resonant frequency of the coil and ferrite spring filter and hence a high level of RFI filtering may be maintained over at broad frequency range.

Figure 12:
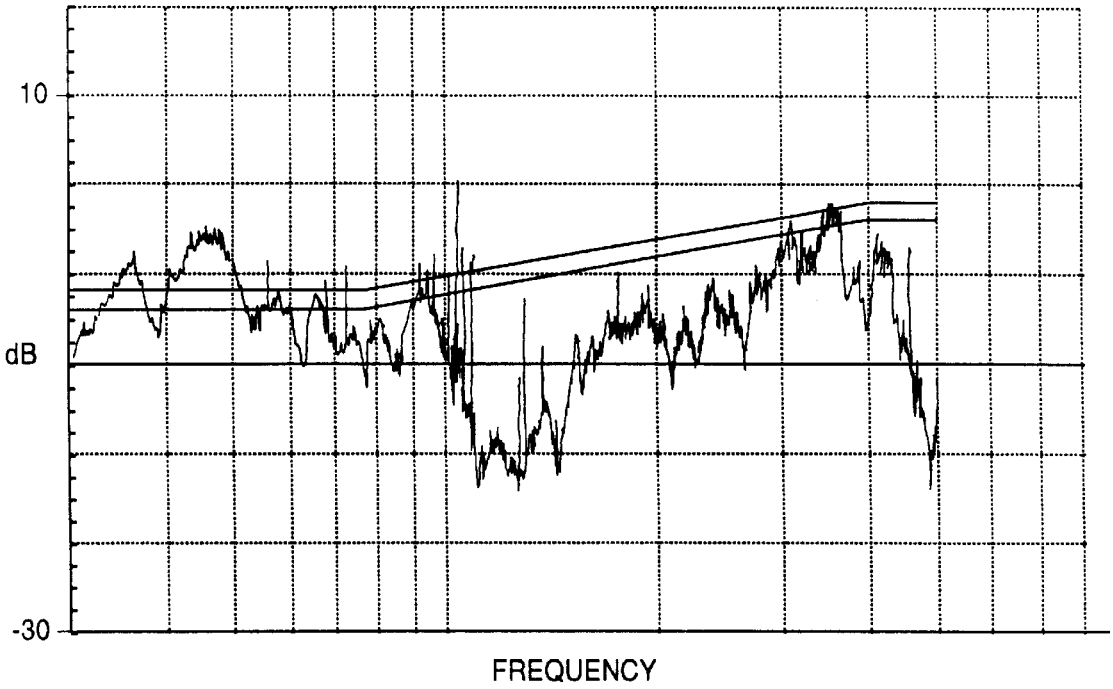
FIG. 12 is a plot of decibels versus frequency plot of radiated noise from a vehicle using a system using a non-resistive spark plug.

Referring now to FIG. 12, an RFI test for an automotive vehicle is illustrated using a non-resistive spark plug. This test was performed using the SAE J551 test standard.

Figure 13:
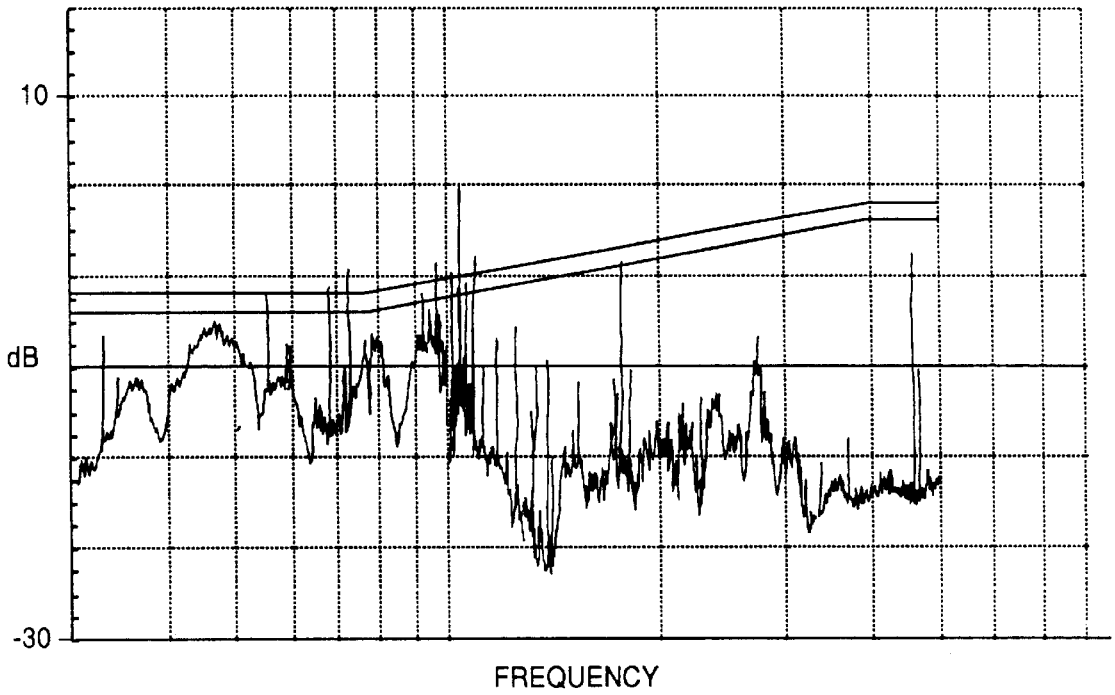
FIG. 13 is a plot of a system according to the present invention.

Referring now also to FIG. 13, a resistive spark plug is used in combination with the ignition coil circuit of the present invention. As can be seen by comparing FIG. 12 to FIG. 13, a lower amount of RFI is attained using the present invention.

Thus, by acting in conjunction with a spark plug resistor, the overall suppression of the full frequency range can be attained.

While particular embodiments of the invention have been shown and described, numerous variations alternate embodiments will occur to those skilled in the art. Accordingly, it is intended that the invention be limited only in terms of the appended claims.

What is claimed is:

1. An ignition system comprising:

an ignition coil assembly having, a coil spring made of electrically conductive material;

an electrical coil connected to deliver electrical energy from said ignition coil assembly via said coil spring; and a ferromagnetic member disposed within said coil spring; and a resistive spark plug electrically coupled to said coil spring.

2. An ignition system as recited in claim 1, wherein said electrical coil is a secondary coil connected to deliver spark energy.

3. An ignition system as recited in claim 1, wherein in said ferromagnetic member is substantially made of ferrite material.

4. An ignition system as recited in claim 1, wherein:

said ferromagnetic member is generally cylindrical and includes a circumferential groove; and said ferromagnetic member includes a retainer disposed in said groove and retaining said ferromagnetic member within said coil spring.

5. An ignition system as recited in claim 1, wherein said ferromagnetic member is generally cylindrical in shape and has a radially-enlarged portion which cooperates with said coil spring to retain said ferromagnetic member within said coil spring.

6. An ignition system as recited in claim 4, wherein said coil spring has two ends and wherein said ferromagnetic member is spaced from both said ends.

7. An ignition system as recited in claim 5 wherein said coil spring has two ends and wherein said ferromagnetic member is spaced from both said ends.

8. An ignition system as recited in claim 2, further comprising an elastomeric boot in which said coil spring is disposed and in which a portion of said spark plug is disposed.

9. An ignition system as recited in claim 1, wherein said coil spring has two ends and wherein said ferromagnetic member is spaced from both said ends.

10. An ignition system as recited in claim 1, wherein said spark plug has an electrically-conductive terminal, said terminal in physical contact with said spring.

11. An ignition system comprising:

an ignition coil assembly having, a coil spring made of electrically conductive material;

an electrical coil connected to deliver electrical energy from said ignition coil assembly via said coil spring; and a ferromagnetic member disposed within said coil spring, said coil spring, and said ferromagnetic member having a first inductance, a first resistance and a first capacitance forming a low pass filter; and a resistive spark plug electrically coupled to said coil spring, said spark plug having a second resistance and a second capacitance forming a high pass filter in series with said low pass filter.

12. An ignition system as recited in claim 11 wherein said first capacitance is in parallel to a series combination of said first inductance and said first resistance.

13. An ignition system as recited in claim 11 wherein said second capacitance is in parallel to said second resistance.

* * * * *